US007527515B1

(12) United States Patent
Olson et al.

(10) Patent No.: US 7,527,515 B1
(45) Date of Patent: May 5, 2009

(54) CABLE CONNECTOR RELEASE

(75) Inventors: Daniel J. Olson, Voorhees, NJ (US); Mikhail L. Veksland, Marllon, NJ (US); Gregory Mark Rueblinger, Stratford, NJ (US); James Byun, Deptford, NJ (US); Steven M. Johnson, Westford, MA (US); Gregory S. Cook, Holliston, MA (US); Kai Wang, Suzhou (CN); John Baron, Lexington, MA (US)

(73) Assignee: Metrologic Instruments, Inc., Blackwood, NJ (US)

( * ) Notice: Subject to any disclaimer, the term of this patent is extended or adjusted under 35 U.S.C. 154(b) by 0 days.

(21) Appl. No.: 12/217,866

(22) Filed: Jul. 9, 2008

(51) Int. Cl.
*H01R 13/627* (2006.01)

(52) U.S. Cl. ..... 439/352; 310/50

(58) Field of Classification Search ..... 439/352, 439/354, 314, 315, 316, 353, 373; 310/50
See application file for complete search history.

(56) References Cited

U.S. PATENT DOCUMENTS

| | | | | |
|---|---|---|---|---|
| 3,860,316 | A | 1/1975 | Hardesty | |
| 4,019,796 | A | 4/1977 | Issler et al. | |
| 4,118,096 | A | 10/1978 | Takahashi | |
| 5,292,258 | A | 3/1994 | Sakurai | |
| 5,378,882 | A * | 1/1995 | Gong et al. | 235/462.45 |
| 5,401,592 | A * | 3/1995 | Gilpin et al. | 429/97 |
| 5,598,082 | A * | 1/1997 | Gilpin et al. | 200/293.1 |
| 5,638,474 | A | 6/1997 | Lampert et al. | |
| 5,692,923 | A | 12/1997 | Sawada | |
| 5,850,078 | A * | 12/1998 | Giordano et al. | 235/462.27 |
| 5,898,789 | A * | 4/1999 | Nichols et al. | 381/361 |
| 6,168,881 | B1 * | 1/2001 | Fischer et al. | 429/97 |
| 6,321,990 | B1 * | 11/2001 | Giordano et al. | 235/472.01 |
| 6,368,132 | B1 | 4/2002 | Okayasu | |
| 6,565,262 | B2 | 5/2003 | Childers et al. | |
| 6,641,424 | B1 | 11/2003 | Hanak et al. | |
| 6,817,529 | B2 * | 11/2004 | Barkan et al. | 235/472.01 |
| 6,851,957 | B1 | 2/2005 | Bhogal et al. | |
| 6,929,184 | B2 * | 8/2005 | Barkan | 235/462.25 |
| 6,939,161 | B1 * | 9/2005 | Yi et al. | 439/373 |
| 7,066,754 | B2 * | 6/2006 | Beck et al. | 439/314 |
| 7,101,212 | B1 | 9/2006 | Larkin | |
| 7,168,972 | B1 | 1/2007 | Autry et al. | |
| 2002/0148902 | A1 * | 10/2002 | Schlieffers | 235/472.01 |
| 2002/0155746 | A1 | 10/2002 | Simpson | |
| 2004/0065741 | A1 | 4/2004 | Reddersen et al. | |

* cited by examiner

*Primary Examiner*—Neil Abrams
*Assistant Examiner*—Phuong Nguyen
(74) *Attorney, Agent, or Firm*—Duane Morris, LLP

(57) ABSTRACT

An electronic handheld device with remote cable release mechanism, a handle portion and method for performing the same. The device includes a housing defining an internal cavity and has an elastically deformable flexible portion. An electrical connector block is disposed in the cavity and includes a female receptacle configured for receiving a male electrical cable connector having a movable locking clip configured to releasably engage the connector block. An actuating protrusion is preferably disposed on the flexible portion of the housing for releasing the cable connector. The protrusion is movable towards the connector block in response to the application of an inward pressing force on the flexible portion. The protrusion operates to depress the locking clip on the cable connector, thereby releasing the cable connector. In another embodiment, a resealable dimple may be provided in the flexible portion which can be punctured via a probe to access the locking clip.

30 Claims, 6 Drawing Sheets

CABLE CONNECTOR RELEASE

FIELD OF THE INVENTION

The present invention relates to data and communication cables, and more particularly to an improved actuator for releasing cable connectors.

BACKGROUND

Modular RJ-type plug-in male connectors for data networking and telecommunication cables, such as for example RJ45 (8-wire) and RJ11 (4-6 wire) respectively, have been used for making electrical circuit connections between various types of electronic equipment and devices. These RJ-type connectors terminate a plurality of electrical wires or conductors carried in the cable and form electrical contacts. The connectors are adapted to be received in device electrical connector blocks or jacks having complementary-shaped female receptacles or sockets with a corresponding set of electrical contacts.

A conventional RJ-type male locking connector and female connector block arrangement is disclosed in U.S. Pat. No. 3,860,316, which is incorporated herein by reference. As illustrated in FIG. 1, a conventional RJ-type male connector 1 is clamped onto an end of a cable 2 carrying a plurality of electrical conductors 5 therein. Connector 1 is received in electrical connector block 3 defining a female receptacle 9 configured to receive male connector 1. Connector block 3 includes a plurality of flexible electrical contacts 4 adapted to make an electrical connection with the conductors 5 via terminal blade contactors 6 mounted in the connector or another similar means. To maintain a tight electrical connection and prevent the connector from slipping out of connector block 3, RJ-type connectors such as connector 1 include a movable resilient and cantilevered cable release locking clip 7. Locking clip 7 is configured with a hook 8 that engages an edge 10 formed by a receptacle 9 in the connector block 3 when the connector is inserted into the block. The connector 1 and usually integral locking clip 7, typically made of a plastic material, snaps into place in connector block 3 and resists axial pullout forces that may be applied to the cable via engagement between the clip hook 8 and receptacle edge 10 as shown. To release the RJ-type connector 1 from connector block 3, a user directly depresses the locking clip 7 inwards towards the connector 1 (typically with a finger) to disengage locking clip hook 8 from connector block edge 10, thereby releasing the cable connector to be simultaneously withdrawn from connector block 3.

RJ-type connectors require a user to have ready physical access to the locking clip in order to disengage the clip from the electrical connector block in the foregoing manner. In certain types of electronic device arrangements, however, the connector block may be recessed or disposed internal to the device. In such devices, the electrical connector block may be mounted for example on a printed circuit board (PCB) in the interior of the device. Therefore, the user may not have sufficient access to directly depress the connector locking clip. One solution to the restricted access problem has been to provide a hole in the equipment housing through which a thin piece of wire or similarly shaped tool is inserted to remotely manipulate and actuate the connector locking clip from the exterior of the device. This type of arrangement is cumbersome for some users. In addition, the hole provides an opening for dust or contaminants to enter the device which could damage the electronics inside. Furthermore, the separate tool or wire necessary to reach the connector locking clip inside the device may be easily lost and/or unavailable when needed. Accordingly, an improved cable connector locking clip actuator is desired.

SUMMARY

The present invention provides a mechanism and method for remotely actuating the releasable locking clip of a male electrical cable connector from the exterior of an electronic device without requiring the user to carry and insert a separate tool through the device housing. In a preferred embodiment, the cable connector is an RJ-type connector. In some possible embodiments, the electronic device may preferably be a handheld device, and more preferably a barcode scanner.

According to a one embodiment, an electronic device with remote cable release mechanism includes: a housing defining an internal cavity and having an elastically deformable flexible portion; an electrical connector block disposed in the cavity for receiving a male cable connector having a movable cable release locking clip configured to releasably engage the connector block; and an actuating protrusion disposed on the flexible portion of the housing for releasing the cable connector. The actuating protrusion preferably is movable towards the cavity and in the general direction of the connector block in response to the application of a pressing force on the flexible portion adjacent the protrusion. The protrusion is operative to depress the locking clip on the cable connector when seated in the connector block for unlocking the cable connector from the connector block. In another embodiment, the housing further includes a cantilevered actuating arm interposed between the release protrusion and the connector block, the actuating arm being movable in unison with the actuating protrusion to depress the locking clip of the cable connector.

In another embodiment, a handheld electronic device with remote cable release mechanism includes: a housing defining an internal cavity and a handle portion; an electrical connector block disposed in the cavity and defining a female receptacle configured for receiving a male electrical cable connector having a movable locking clip configured to releasably engage the receptacle; and a cap attached to an end of the housing handle portion. Preferably, at least a part of the cap includes a flexible portion made of an elastically deformable material that is movable in response to the application of an inward pressing force applied to the flexible portion. An actuating protrusion is provided and disposed on the flexible portion of the cap for releasing the cable connector. The protrusion preferably is movable towards the cavity and in the general direction of the connector block in response to the application of an inward pressing force on the flexible portion and operative to depress the locking clip on the cable connector when seated in the connector block for unlocking the cable connector from the connector block, thereby releasing the cable connector for removal from connector block.

In another embodiment, a barcode scanner with remote cable release mechanism includes: a housing defining an internal cavity and a handle portion; an electrical connector block disposed in the cavity and defining a female receptacle configured for receiving a male electrical cable connector having a movable locking clip configured to releasably engage the receptacle; and an end cap attached to an end of the housing handle portion. Preferably, at least a part of the cap is disposed laterally to the connector block and defines a flexible portion made of an elastically deformable material. The flexible portion preferably is movable towards the cavity and in the general direction of the connector block in response to the application of a lateral pressing force inwards on the flexible portion. An actuating protrusion extending laterally inwards from the flexible portion of the cap is provided for releasing the cable connector. The protrusion preferably is movable towards the cavity in response to the application of the pressing force on the flexible portion and is operative to depress the locking clip on the cable connector when seated in the connector block for unlocking the cable connector from the connector block.

A method of releasing an electrical cable connector from a connector block of an electronic device is provided. In one embodiment, the method includes: providing a male electrical cable connector seated in a female electrical connector block disposed inside an electronic device housing, the cable connector having a movable locking clip engaged with connector block; applying an external pressing force on a flexible portion of the housing to deform the flexible portion; displacing the flexible portion of the housing towards engagement with the locking clip of the cable connector; and depressing the locking clip via movement of the flexible portion of the housing to disengage the clip from the connector block. In one embodiment, the depressing step includes directly engaging the flexible portion with the locking clip. In another embodiment, the depressing step is performed by an actuating protrusion formed on the inside of the flexible portion of housing that engages the locking clip. In yet another embodiment, the depressing step is performed by a cantilevered actuating arm disposed on the housing that engages the locking clip and is movable in response to deforming the flexible portion. In one embodiment, the electronic device housing forms part of a barcode scanner.

BRIEF DESCRIPTION OF THE DRAWINGS

The features of the preferred embodiments will be described with reference to the following drawings where like elements are labeled similarly, and in which.

Figure 1:
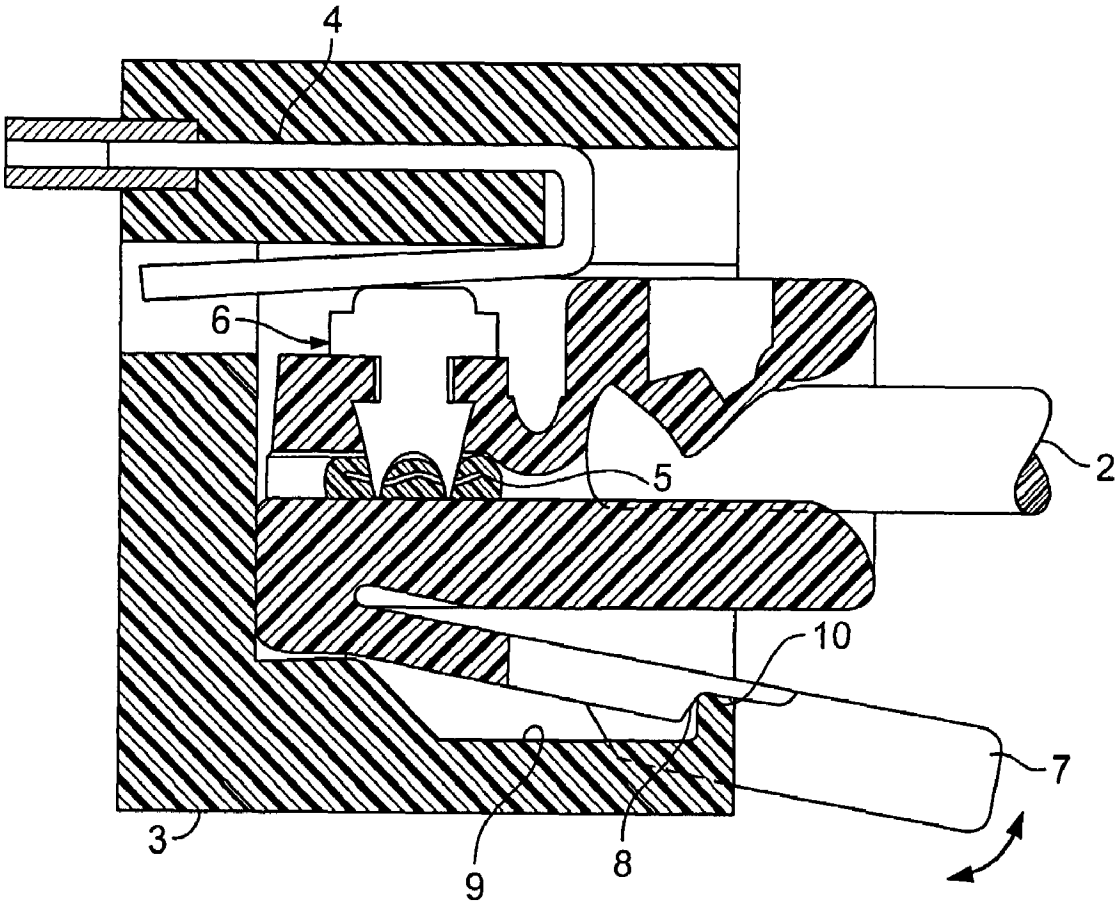
FIG. 1 (Prior Art)
FIG. 1 is cross-section side view of a prior art conventional RJ-type locking male electrical connector and corresponding female electrical connector block.

All drawings are schematic and are not drawn to scale.

DETAILED DESCRIPTION

This description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected" and "interconnected," refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

According to one possible embodiment, a remote cable release actuator mechanism for RJ-type male locking electrical connectors according to principles of the present invention will now be described with non-limiting reference to a handheld barcode laser scanner 20. It will be appreciated, however, that the remote cable release actuator can be used with any type of scanner or other electronic device using RJ-type or similar electrical connectors having depressible locking clips.

Figure 2:
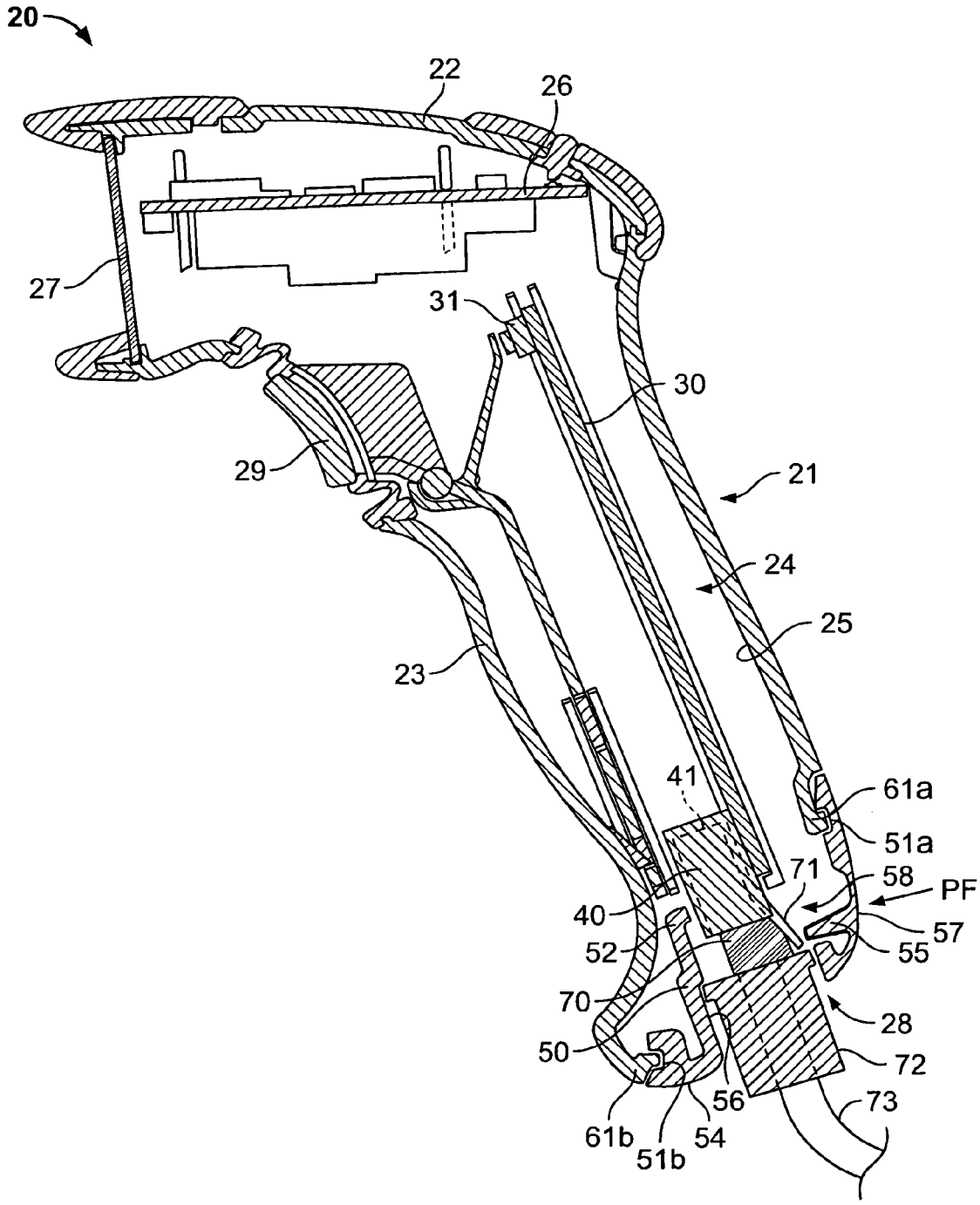
FIG. 2 is a cross-sectional side view of an electronic device according to principles of the present invention in the form of a handheld barcode scanner incorporating a first embodiment of a remote cable release mechanism.
Figure 3:
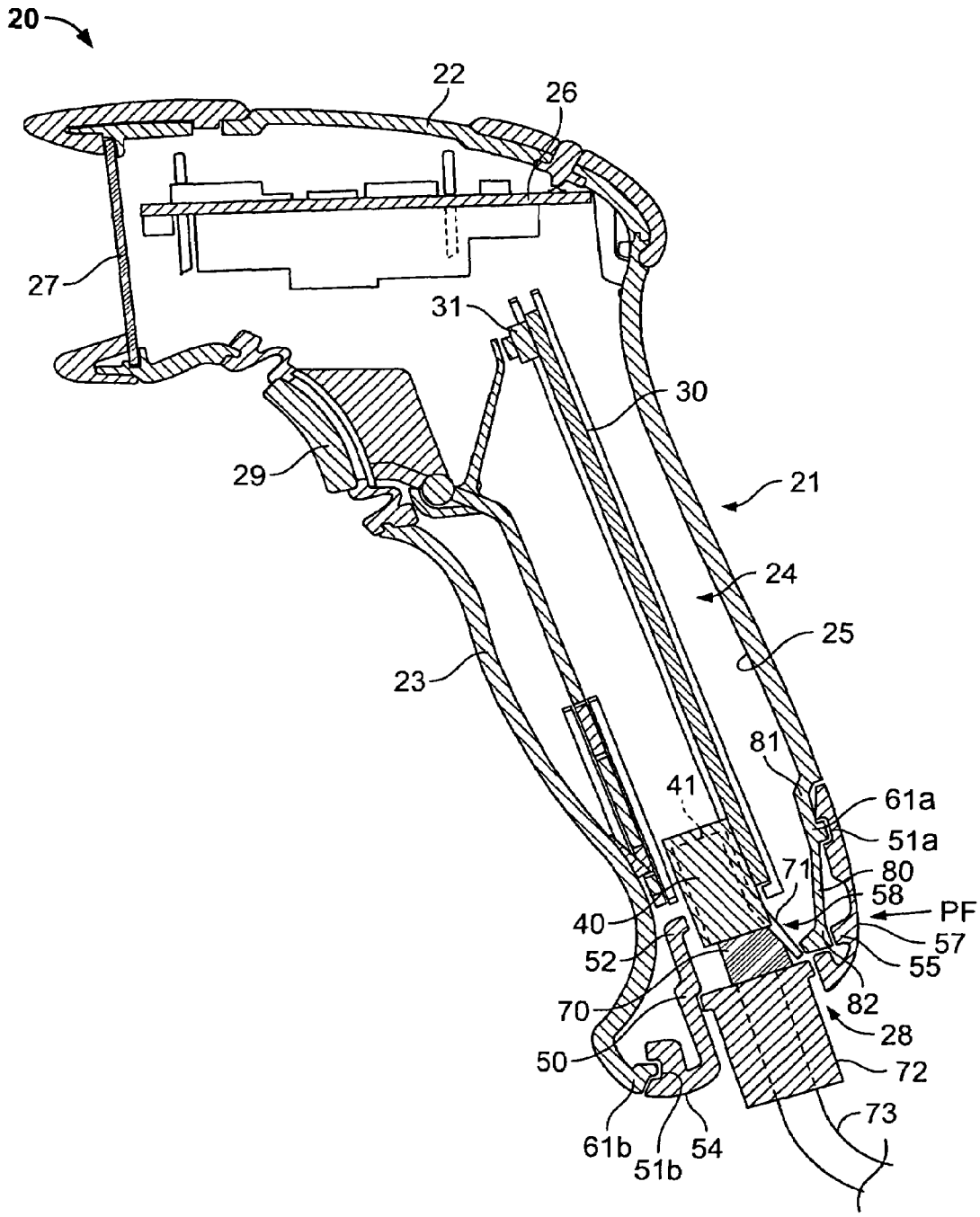
FIG. 3 is a cross-sectional side view of an electronic device according to principles of the present invention in the form of a handheld barcode scanner incorporating a second embodiment of a remote cable release mechanism.
Figure 4:
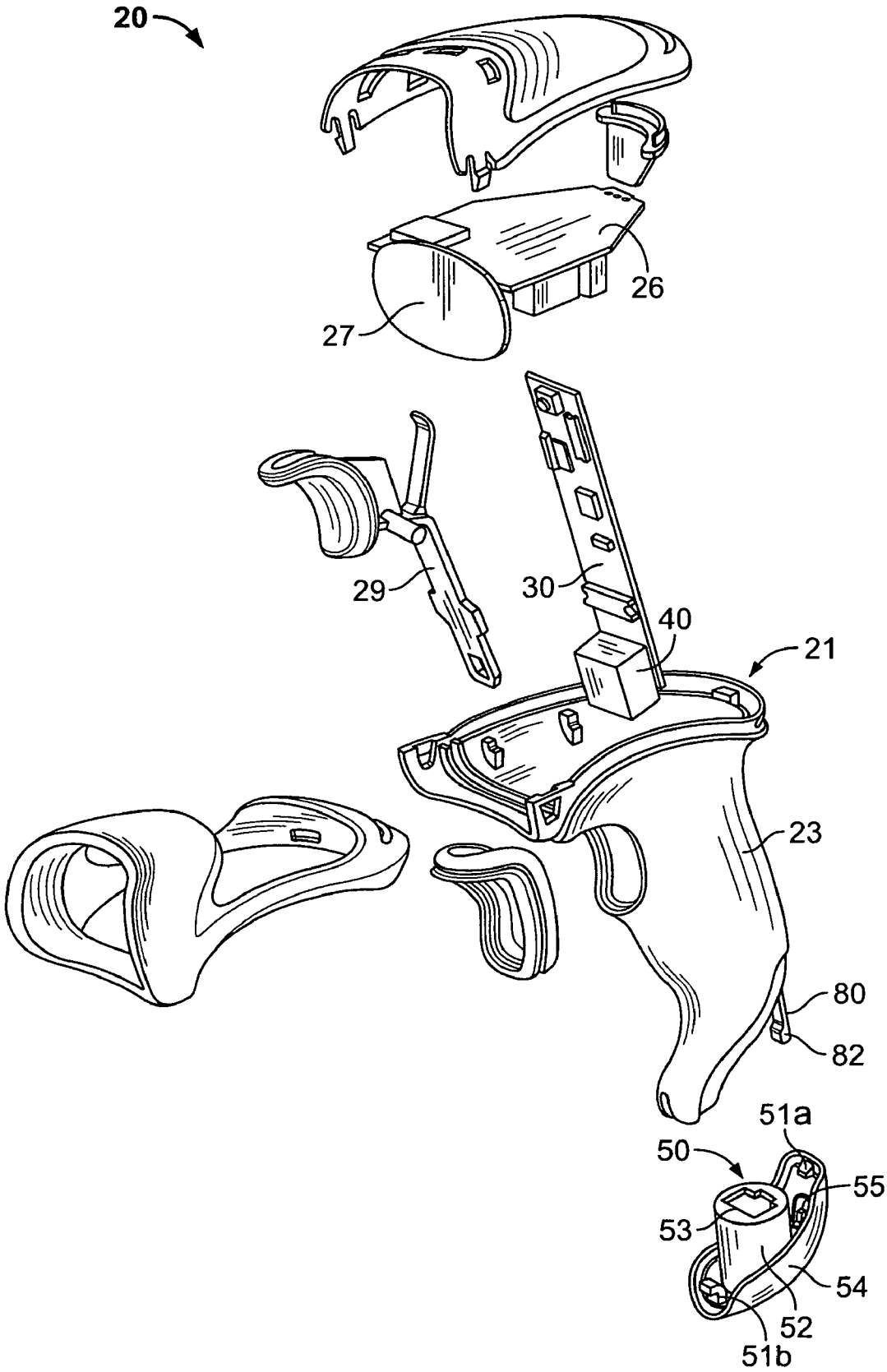
FIG. 4 is an exploded perspective view of the handheld scanner of FIG. 3.

Referring to FIGS. 2-4, a portable handheld scanner 20 in one possible embodiment includes a housing 21 having an upper portion 22 and a lower handle portion 23 for holding the scanner. Housing 21 defines an internal cavity 24 bounded by an interior surface 25 of the housing. Upper portion 22 houses inside a main printed circuit board (PCB) 26 which incorporates the scanning system electronics. A lens 27 is attached to upper housing portion 22 for projecting the laser therethrough.

Lower handle portion 23 defines a cable entrance or opening 28 at the bottom for receiving a portion of an electrical cable and male RJ-type electrical connector 70 into the internal cavity 24 of housing 21. Handle portion 23 further includes an interface PCB 30 with a trigger switch 31 which is actuated by a user via trigger mechanism 29 mounted in housing 20. As shown in FIGS. 2 and 3, interface PCB 30 is disposed in internal cavity 24 of housing 21 and spaced inwards from bottom opening 28 of handle portion 23. A conventional electrical connector block 40 is mounted on PCB 30, which includes a receptacle 41 configured to receive a conventional RJ-type male locking electrical connector 70. Connector block 40 may be any commercially-available type electrical connector block suitable for receiving locking RJ-type male connectors. Therefore, connector block 40 may be configured and include features similar to connector block 3 shown in FIG. 1 in one non-limiting example. Connector block 40 contains electrical contacts intended to mate with corresponding electrical contacts on the male RJ-type connector for establishing an electrical circuit connection. Male RJ-type connector 70 includes a releasable, movable cantilevered locking clip 71 that lockingly engages an edge in the receptacle in the same manner shown and described herein in conjunction with FIG. 1. Accordingly, locking clip 71 is operated by depressing the clip inwards towards the main body of connector 70 to unlock the connector from connector block 40.

With continuing reference to FIGS. 2-4, connector block 40 is preferably positioned near a lower portion of PCB 30 and is axially aligned with cable opening 28 in handle portion 23 of housing 20 to facilitate insertion of male cable connector 70. The opening in receptacle 41 faces downwards towards cable opening 28 in housing handle portion 23. In the embodiment as shown, it is noted that connector block 40 is spaced inwards from cable opening 28 in handle portion 23. As such, locking clip 71 of connector 70 is not readily accessible to be depressed by a user when the connector is seated in connector block 40 as shown.

Referring to FIGS. 2-4, housing 21 of scanner 20 further includes an elastically-deformable flexible portion 57 for releasing cable connector 70 from connector block 40. Preferably, flexible portion 57 is formed of an elastically-deformable rubber or similar elastomeric material that is capable of being repeatedly deformed upon applying an external force or pressure on the cap. Flexible portion 57 preferably has an elastic memory and will return to its original pre-deformation configuration upon removing the external force or pressure. In a preferred embodiment, flexible portion 57 is preferably structured to yield and be deformable in response to applying firm, but moderate finger or thumb pressure on portion 57.

In one possible embodiment, flexible portion 57 may integrated with and preferably forms at least a part of a cable connector end cap 50 that may be fitted onto an end of housing handle portion 23. In a preferred embodiment, the entire end cap 50 may be formed as a single piece of an elastically deformable material such as rubber or a similar elastomeric. In other possible embodiments contemplated, the end cap 50 may be made of a substantially rigid and inelastic material (e.g., rigid thermoplastic, metal, etc.) except for flexible portion 57 provided therein. Flexible portion 57 may be any suitable shape depending on the application requirements. In one possible embodiment as shown in FIGS. 2-4, flexible portion 57 may be configured as a generally upturned flange on the rear of end cap 50, and actually forms part of the lower rear section of handle portion 23. In other possible embodiments, flexible portion 57 may be positioned on handle portion 23 and configured as generally shown, but be a separate component from end cap 50.

End cap 50 is preferably structured to be received in and secured to cable opening 28 in the bottom of housing 21 as shown. To facilitate retaining cap 50 to housing 21, in one embodiment the cap may be provided with notches 51*a*, 51*b* which receive complementary lugs 61*a*, 61*b* formed on housing handle portion 23. Other suitable arrangements may be provided, however, to retain cap 50 to handle portion 23.

With continuing reference to FIGS. 2-4, cap 50 in one embodiment further includes a base 54 with aperture 56 formed therein for passing male connector plug 70 and electrical cable 73 through the cap. Cable 73 may include a flexible rubber boot 72 in some embodiments to seal aperture 56 for preventing dust and debris from entering scanner 20, and to reinforce the cable connection to the scanner 20 which experiences the largest bending forces when the scanner is handled by a user. In one embodiment, cap 50 may further include tubular portion 52 extending in an upwards direction from base 54. As best shown in FIG. 4, tubular portion 52 includes top opening 53, which in one embodiment may be configured to pass a male RJ-type connector through for connecting the male cable connector 70 to connector block 40. In other embodiments, top opening 53 may simply be circular in configuration. A window 58 of suitable size and configuration (see FIGS. 2 and 3) may be disposed in the rear of tubular portion 52 to provide access for actuating protrusion 55 or actuating arm 80 to engage locking clip 71, as further described herein. Although cap 50 in a preferred embodiment includes a tubular portion 52, it will be appreciated that in other embodiments the tubular portion may be omitted.

With continuing reference to FIGS. 2-4, deformable flexible portion 57 preferably includes a cable release actuating protrusion 55 disposed on and extending away from an interior surface of the flexible portion 57. In a preferred embodiment, flexible portion 57 and actuating protrusion 55 are part of end cap 50. Protrusion 55, which in some embodiments may be in the shape of a tab or lug, is positioned and operable for releasing cable connector 70 from connector block 40 on PCB 30. Protrusion 55 preferably extends in a lateral direction inwards from flexible portion 55 toward connector block 40, and more preferably towards the location occupied by locking clip 71 of male connector 70 when seated in the connector block. Because protrusion 55 is preferably disposed on the part of flexible portion 57 intended to be pushed in by a user, protrusion 55 is movable essentially simultaneously with deforming and displacing flexible portion 57 of end cap 50 when a user presses inwards on flexible portion 57. In a preferred embodiment, therefore, protrusion 55 is movable in an inwards direction to engage and depress locking clip 71 on male cable connector 70, thereby unlocking the cable connector 70 from connector block 40. Accordingly, protrusion 55 is preferably laterally aligned with release clip 71 for engaging the clip.

In the first embodiment of a remote cable release mechanism shown in FIG. 2, cable release actuating protrusion 55 preferably is positioned to lightly contact or be slightly spaced laterally apart from but proximate to release clip 71 of connector 70 when the connector is seated in connector block 40. Therefore, protrusion 55 will move inwards to directly engage and depress locking clip 71 of connector 70 when flexible portion 57 of end cap 55 is pressed inwards. Protrusion 55 is therefore movable from a first position in which locking clip 71 is not depressed to a second position in which locking clip 71 is depressed to release male connector 70 from connector block 40.

In an alternative second embodiment of a remote cable release mechanism shown in FIGS. 3 and 4, handle portion 23 of housing 21 includes a cantilevered, elastically-deformable actuating arm 80 interposed between release clip 71 and cable release actuating protrusion 55. Actuating protrusion 55 is slightly shorter in this embodiment than in the embodiment of FIG. 2. Actuating arm 80 has a fixed end 81 attached to handle portion 23 of housing 21 which forms a pivot point and an opposite free end 82 configured and positioned to engage connector release clip 71 on one side and actuating protrusion 55 on an opposite side, as shown in FIG. 3. Actuating arm 80 may be formed as an integral part of housing handle portion 23 as shown or a separate component mounted to the handle portion or housing 21. In a preferred embodiment, actuating arm 80 is an integral part of handle portion 23. In one possible embodiment, both handle portion 23 and integral actuating arm 80 may be made of a generally hard, rigid plastic. Actuating arm 80 is made flexible and has an elastic memory by virtue of its cantilevered mounting, and in some embodiments making at least a portion of the arm relatively narrow in width and/or depth in relation to the rest of handle portion 23 as shown in FIGS. 3 and 4.

In one possible embodiment, free end 82 of actuating arm 80 may be enlarged and generally anvil-shaped as shown in FIG. 3 to better engage protrusion 55 and release clip 71. Portions of actuating arm 80 above free end 82 may be generally thinner as shown in FIG. 3 (left to right dimension) to provide suitable flexibility to the arm. In this embodiment, actuating protrusion 55 will act through actuating arm 80 to release locking clip 71 of connector 70 from connector block 40. An inward force applied to flexible portion 57 will cause protrusion 55 to contact and move arm 80 inwards, which will in turn directly engages and depresses the locking clip 71 to unlock the connector from connector block 40.

It should be noted that the embodiment shown in FIG. 4 differs primarily from the embodiment of FIG. 2 by the presence of actuating arm 80 (also shown in FIG. 3). Accordingly, with the exception of the actuating arm 80, FIG. 4 illustrates an exploded perspective view applicable to both embodiments of FIGS. 2 and 3 in all other aspects.

A preferred method of using the remote cable release actuator will now be described with reference to an electronic device having a cable connector end cap 50 with integrated cable release. It will be appreciated that the method is not limited for use with this exemplary embodiment or a barcode scanner alone described herein. Accordingly, the method may be used for many other types of electronic device applications.

Referring to the first embodiment of FIG. 2, a conventional male RJ-type cable connector 70 is shown seated and locked in PCB connector block 40 via cable release locking clip 71 in the manner described herein (e.g., hook 8 on the locking clip 7 engaged with edge 10 formed by receptacle 9 of the connector block as shown in FIG. 1). Pulling axially on cable 73 will not release connector 70 from connector block 40. Connector block 40 is disposed inside handle portion 23 of housing 21 and space inwards from and above opening 28 in the handle portion such that there is insufficient direct access to cable locking clip 71 for a user to depress the clip and release connector 70 from the connector block.

To release connector 70 from connector block 40, a user manually presses or pushes laterally inwards on flexible portion 57 of end cap 50 preferably at a location opposite actuating protrusion 55. The application of this external and lateral deforming force or pressure on flexible portion 57, as represented by directional force arrow PF in FIGS. 2 and 3, deforms flexible portion 57 and displaces the flexible portion in an inwards direction. Actuating protrusion 55 concomitantly moves laterally inwards in turn towards locking clip 71 of connector 70 with the displacement of flexible portion 57. Actuating protrusion 55 in turn initially engages connector locking clip 71, if not already touching or engaged with the protrusion. Further inward pressure on flexible portion 57 depresses locking clip 71, which is moved inwards toward male connector 70 into a release position. This disengages locking clip 71 from connector block 40 in the manner described herein previously with reference to FIG. 1, thereby unlocking the connector. The user preferably continues to press inwards on flexible portion 57, and simultaneously pulls axially on cable 73 in a direction away from connector block 40 to unseat connector 70 from the connector block. Connector 70 and cable 73 may then be withdrawn from inside internal cavity 24 of housing 21. The user may then release flexible portion 57 which removes the externally-applied lateral force. Flexible portion 57 springs back outwards to its initial pre-deformed configuration due to its elastic memory. Actuating protrusion 55 concomitantly returns laterally to its initial position.

The alternative second embodiment of a remote cable release mechanism shown in FIGS. 3 and 4 functions in the same general manner as the method just described with respect to the first embodiment shown in FIG. 2. The embodiment of FIGS. 3 and 4, however, includes the cantilevered actuating arm 80 positioned and interposed between actuating protrusion 55 and connector locking clip 71. Accordingly, when the inward externally applied lateral pressing force PF is a placed on flexible portion 57 by the user, actuating protrusion 55 moves inwards to engage anvil-shaped end 82 of actuating arm 80. In response, actuating arm 80 moves in unison with actuating protrusion 55 and pivots about end 81 attached to housing handle portion 23. Actuating arm 80 in turn is forced and moves inwards towards locking clip 71 by actuating protrusion 55. End 82 of actuating arm 80 engages and depresses locking clip 71 to release cable connector 70 from connector block 40 in the same manner already described herein.

FIGS. 5-8 illustrate a third embodiment of a cable release mechanism in the form of an elastically deformable, self-sealing resealable elastomeric or rubber closure 100 for sealing a cable connection to an electronic device. In a preferred embodiment, closure 100 may be in the form of an end closure cap that is attachable to a housing handle portion 23 of an electronic device, which in one embodiment a barcode scanner 20. However, it will be appreciated that deformable cable closure 100 is not limited in configuration or application to an end cap, and in other embodiments closure 100 may form a deformable portion on part of a portable or stationary electronic device housing. In one example, closure 100 may be in the form of a deformable elastomeric panel attached to or formed as an integral part of an electronic device housing (not shown).

Self-sealing end cap 100 includes a rear portion 101, a front portion 102, a bottom cable opening 105 for receiving electrical cable 73, and a top opening 106 which receives housing 21 of scanner 20. Bottom cable opening 105 is defined by a bottom annular surface 120 (see FIG. 5) in one embodiment which may include a flexible inner flange ring 122 that engages an external surface of cable 73 as shown to form a tight seal around the cable 73. Preferably, annular flange ring 122 has a high polish surface for improved sealing. Top opening 106 is defined by a top annular surface 121 to form a tight seal around the scanner housing 21. Preferably, annular surface 121 also has a high polish surface for improved sealing.

Preferably, bottom and top openings 105, 106 are configured and adapted to form a tight seal connection with cable 73 and housing 21, respectively. Top opening 106 preferably is shaped to conform to the shape of scanner housing 21 that may be provided. In one embodiment, top opening 106 may be oval; however, any suitable other shape may be used. In one embodiment, bottom opening 105 may be round; however, any suitable other shape may be used.

Figure 7:
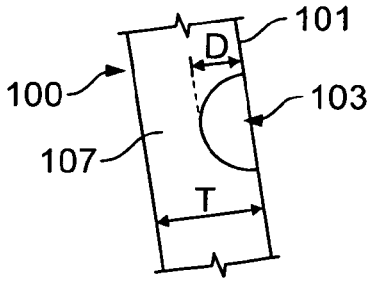
FIG. 7 is a close-up view of detail 7 in FIG. 5 of the resealable remote cable release mechanism.
Figure 6:
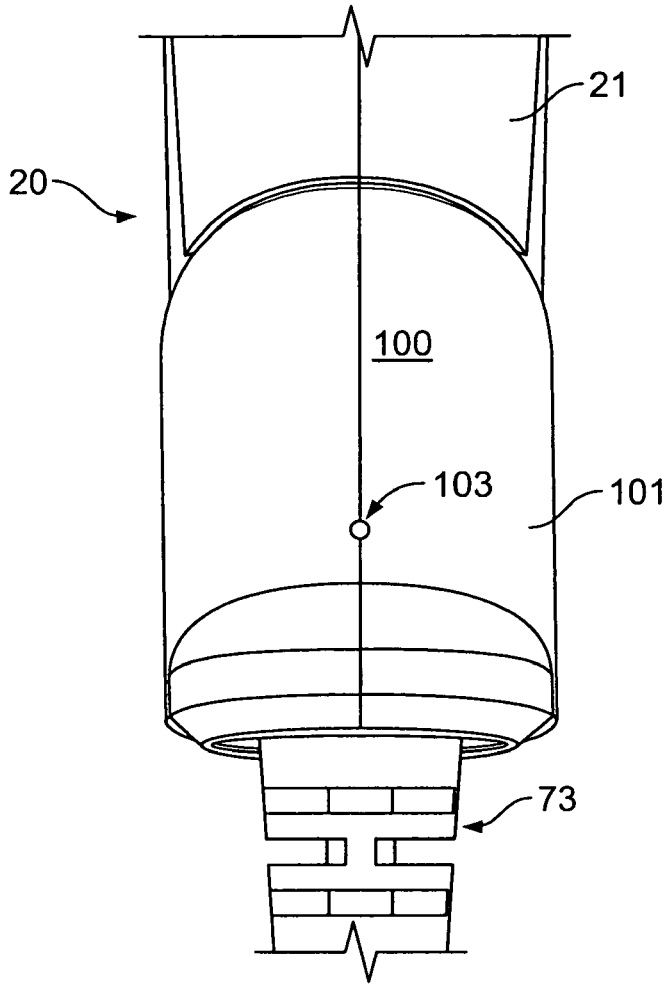
FIG. 6 is a rear view thereof.
Figure 8:
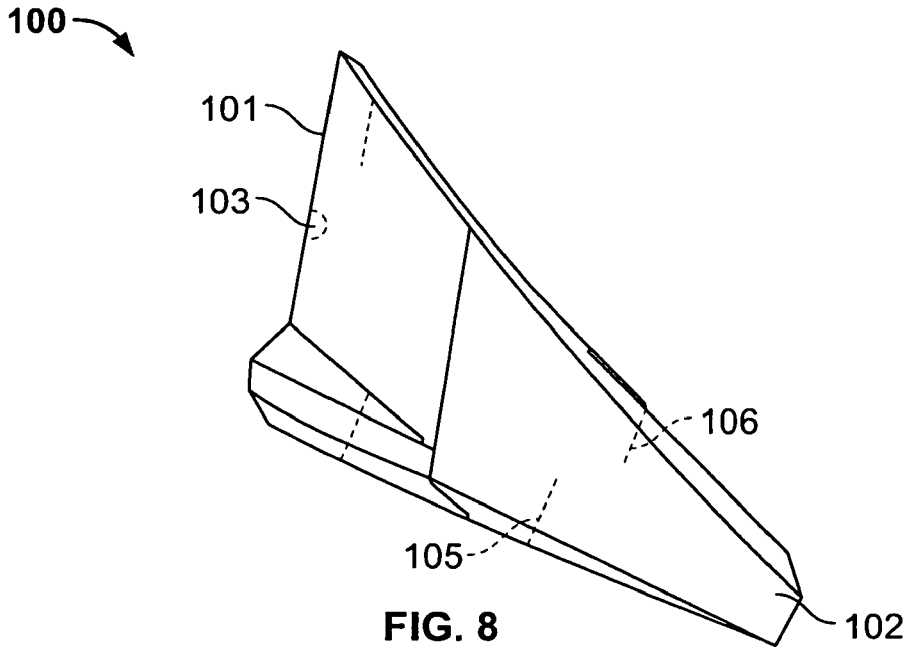
FIG. 8 is a side view of the resealable remote cable release mechanism of FIG. 5.

Still referring to FIGS. 5-8, self-sealing end cap 100 preferably includes a recess or dimple 103, which in one embodiment may be formed in rear portion 101 of the end cap as shown. In a preferred embodiment, as best shown in FIG. 7, dimple 103 has a depth D that partially extends through the full wall thickness T of rear portion 101 of end cap 100, preferably without penetrating completely through the connector wall 107. In contrast to the known practice of providing a full-penetration hole through the scanner housing to access the connector locking clip 71, the recess or dimple 103 of the preferred embodiment has a depth D less than the wall thickness T of end cap 100. This ensures that the end cap remains sealed to protect the electronic components within scanner 20 during normal operation from environmental contaminants, such as particulate debris, chemical fumes, dust, etc.

In one embodiment, dimple 103 may be generally shaped as a half-sphere having a rounded perimeter in width (see FIG. 6) and a concave shape in depth (see FIG. 7). However, numerous other suitable recess shapes may be used without limitation such as a cross, diamond, square, rectangle, triangle, hexagon, oval, etc. Accordingly, the invention is not limited to any particular shape recess or dimple.

Figure 5:
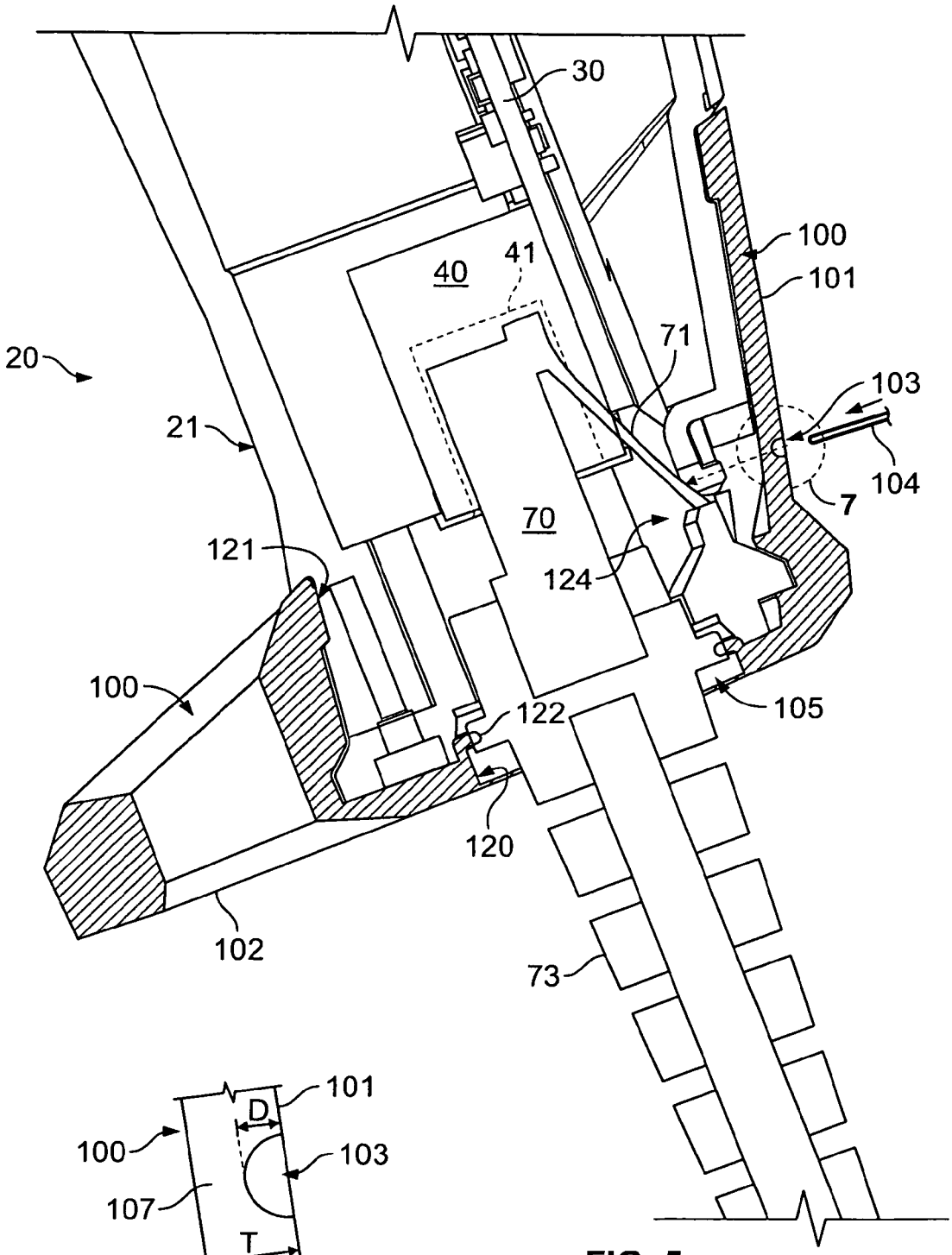
FIG. 5 is a cross-sectional side view of a third embodiment of a resealable remote cable release mechanism.

In one embodiment, end cap 100 defines an internal clip chamber 124 that is sized and configured to receive locking clip 71 of RJ-type connector 70 when seated in connector block 40. Dimple 103 is preferably aligned with clip chamber 124, and more preferably with locking clip 71 of RJ-type male connector 70 when positioned in chamber 124 with connector 70 seated in electrical connector block 40 as best shown in FIG. 5 so that the locking clip may be actuated to disengage the connector from the connector block, in a manner further described herein.

End cap 100 is preferably made of a flexible material, such as a rubber or elastomeric material that preferably is capable of at least partially resealing itself if punctured or penetrated. In one embodiment, self-resealing connector 100 may be made without limitation of a material such as Santoprene™ brand thermoplastic vulcanizates available from Advanced Elastomer Systems, LP of Akron, Ohio. However, it will be appreciated other suitable flexible elastomeric or rubber materials may be used and the invention is not limited to the specific exemplary material described.

A method of using a deformable, self-sealing resealable end cap 100 to release an RJ-type male connector 70 in the following manner will now be described. Starting with end cap 100 attached to scanner 20 as shown in FIG. 5, a user may insert a probe 104 such as a pin into dimple 103 and apply sufficient force inwards towards RJ connector 70 to puncture or penetrate completely through wall 107 of the end cap, thereby creating temporary opening in the end cap. The probe 104 will temporarily spread and expand material apart from wall 107 adjacent to dimple 103 and probe 104. The user may continue to insert probe 104 until locking clip 71 of RJ connector 70 is contacted. The user may then continue to apply pressure inwards against clip 71 until locking clip 71 is sufficiently actuated to release RJ connector 70 from connector block 40. The user may then pull cable 73 away from scanner 20 to remove the cable and RJ connector 70 connector thereto.

To reseal the temporary opening created in end cap 100 through dimple 103, the user may simply retract probe 104 from the scanner and end cap. The rubber or elastomeric material of end cap 100 will spring back and return to its original position and shape to reseal the end cap. It will be appreciated that a perfect or complete seal at dimple 103 is not required to keep a substantial amount of environmental contaminants out of scanner 20 in all instances. Therefore, only a substantial, but not necessarily complete seal need be re-established at dimple 103 after probe 104 is withdrawn.

In alternative embodiments of a self-sealing resealable end cap, the location where the end cap should be punctured with a probe by a user to access the RJ cable connector locking clip may be marked on the cap in lieu of providing a recess or dimple. Accordingly, the self-sealing end cap may include indicia such as a graphic, words, or a combination thereof that are etched, painted, embossed, molded into the end cap, or otherwise marked or affixed thereto to identify the intended puncture location.

Although the preferred embodiments have been described with reference to exemplary handheld barcode scanners, it will be appreciated by those skilled in the art that the remote cable release mechanism and method described herein may be used with equal benefit for other types of electronic devices, handheld or stationary fixed mounted, that use RJ-type or equivalent male electrical connectors. Accordingly, the invention is not limited to use with barcode scanners alone.

While the foregoing description and drawings represent preferred or exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof, which may be particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A handheld scanner electronic device with remote cable release mechanism comprising:

a housing defining an internal cavity and a cap having an elastically deformable flexible portion;

an electrical connector block disposed in the cavity for receiving a male cable connector having a movable cable release locking clip configured to releasably engage the connector block; and an actuating protrusion disposed on the flexible portion of the cap for releasing the cable connector, the protrusion being movable towards the cavity in response to the application of an inward pressing force on the flexible portion and operative to depress the locking clip on the cable connector when seated in the connector block for unlocking the cable connector from the connector block.

2. The electronic device of claim 1, wherein the protrusion is formed on an interior surface of the flexible housing portion and extends inwards toward the cavity.

3. The electronic device of claim 1, wherein the pressing force is in an inwards direction towards the cavity and elastically deforms the flexible portion.

4. The electronic device of claim 1, wherein the flexible portion is made of a rubber or elastomeric material.

5. The electronic device of claim 1, wherein the actuating protrusion has the shape of a lug or tab.

6. The electronic device of claim 1, wherein the flexible portion forms part of an end cap connected to a handle portion of the housing.

7. The electronic device of claim 1, wherein the electronic device is a handheld device barcode scanner.

8. The electronic device of claim 1, wherein the connector block is configured to receive an RJ-type cable connector.

9. The electronic device of claim 1, wherein the housing further comprises a cantilevered actuating arm interposed between the release protrusion and the connector block.

10. A handheld scanner electronic device with remote cable release mechanism comprising:

a housing defining an internal cavity and a handle portion;

an electrical connector block disposed in the cavity and defining a female receptacle configured for receiving a male electrical cable connector having a movable locking clip configured to releasably engage the receptacle;

a cap attached to an end of the housing handle portion, at least a part of the cap including a flexible portion made of an elastically deformable material;

an actuating protrusion disposed on the flexible portion of the cap for releasing the cable connector, the protrusion being movable towards the cavity in response to the application of an inward pressing force on the flexible portion and operative to depress the locking clip on the cable connector for unlocking the cable connector from the connector block.

11. The electronic device of claim 10, wherein the entire cap is made of an elastically deformable material.

12. The electronic device of claim 10 wherein the housing further comprises a cantilevered actuating arm interposed between the release protrusion and the connector block.

13. The electronic device of claim 10, wherein the cap includes an opening for receiving the cable connector therethrough to be inserted into the connector block.

14. The electronic device of claim 10, wherein the device is a barcode scanner.

15. The electronic device of claim 10, wherein the housing further comprises a cantilevered actuating arm interposed between the release protrusion and the connector block, the actuating arm being movable in unison with the actuating protrusion to depress the locking clip of the cable connector.

16. The electronic device of claim 10, wherein the connector block is configured to receive an RJ-type cable connector.

17. The scanner of claim 10, wherein the connector block is configured to receive an RJ-type cable connector.

18. A barcode scanner with remote cable release mechanism comprising:

a housing defining an internal cavity and a handle portion;

an electrical connector block disposed in the cavity and defining a female receptacle configured for receiving a male electrical cable connector having a movable locking clip configured to releasably engage the receptacle;

an end cap attached to an end of the housing handle portion, at least a part of the cap being disposed laterally to the connector block and defining a flexible portion made of an elastically deformable material, the flexible portion being movable towards the cavity in response to the application of a lateral pressing force inwards on the flexible portion;

an actuating protrusion extending laterally inwards from the flexible portion of the cap for releasing the cable connector, the protrusion being movable towards the cavity in response to the application of the pressing force on the flexible portion and operative to depress the locking clip on the cable connector when seated in the connector block for unlocking the cable connector from the connector block.

19. The scanner of claim 18, wherein the actuating protrusion has the shape of a lug or tab.

20. The scanner of claim 18, wherein the housing further comprises a cantilevered actuating arm interposed between the release protrusion and the connector block, the actuating arm being movable in unison with the actuating protrusion to depress the locking clip of the cable connector.

21. A method of releasing an electrical cable connector from a connector block of a handheld scanner electronic device, the method comprising:

providing a male electrical cable connector seated in a female electrical connector block disposed inside an electronic device housing, the cable connector having a movable locking clip engaged with connector block;

applying an external pressing force on an actuating protrusion to deform the flexible portion of a cap;

displacing the flexible portion of the cap towards engagement with the locking clip of the cable connector; and depressing the locking clip via displacement of the flexible portion of the housing to disengage the clip from the connector block.

22. The method of claim 21, wherein the depressing step includes directly engaging the flexible portion with the locking clip.

23. The method of claim 21, wherein the depressing step is performed by an actuating protrusion formed on the inside of the flexible portion of cap that engages the locking clip.

24. The method of claim 21, wherein the depressing step is performed by a cantilevered actuating arm disposed on the housing that engages the locking clip and is movable in response to deforming the flexible portion.

25. The scanner of claim 21, wherein the electronic device housing forms part of a handheld barcode scanner.

26. A handheld scanner electronic device with cable release mechanism comprising:

a housing defining an internal cavity and a handle portion;

an electrical connector block disposed in the cavity and defining a female receptacle configured for receiving a male electrical cable connector having a movable locking clip configured to releasably engage the receptacle;

a self-sealing end cap attached to the housing, at least a part of the cap including a flexible portion made of an elastically deformable material and having a cross-sectional wall thickness;

a dimple disposed on the flexible portion of the cap for releasing the cable connector, the dimple having a depth that is less than the wall thickness of the flexible portion of the cap, wherein the dimple may be punctured by a probe inserted into the housing to release the cable connector when seated in the electrical connector block and the cap is at least partially resealable when the probe is withdrawn.

27. The electronic device of claim 26, wherein the end cap is made of an elastomeric material or rubber.

28. The electronic device of claim 26, further comprising the cable connector seated in the connector block, the dimple aligned with the locking clip of the connector for engaging the probe.

29. A method of releasing an electrical cable connector from a connector block of a handheld scanner electronic device, the method comprising:

providing a male electrical cable connector seated in a female electrical connector block disposed inside an electronic device housing, the cable connector having a movable locking clip engaged with connector block;

aligning a dimple on a self-sealing elastomeric deformable portion of a cap with the locking clip, the dimple extending partially through but not penetrating the deformable portion;

inserting a probe through the dimple to puncture the deformable portion and form an opening; and engaging the locking clip of the cable connector with the probe to release the connector from the connector block.

30. The method of claim 29, further comprising retracting the probe from the deformable portion and at least partially resealing the opening.

* * * * *